US010533341B1

(12) United States Patent
Hicks

(10) Patent No.: US 10,533,341 B1
(45) Date of Patent: Jan. 14, 2020

(54) METHOD AND APPARATUS FOR DISPENSING FENCE WIRE

(71) Applicant: Nickey L Hicks, Repton, AL (US)

(72) Inventor: Nickey L Hicks, Repton, AL (US)

( * ) Notice: Subject to any disclaimer, the term of this patent is extended or adjusted under 35 U.S.C. 154(b) by 118 days.

(21) Appl. No.: 15/833,739

(22) Filed: Dec. 6, 2017

(51) Int. Cl.

| | |
|---|---|
| ***E04H 17/26*** | (2006.01) |
| ***B65H 49/32*** | (2006.01) |
| ***B65H 59/04*** | (2006.01) |
| ***B65H 49/20*** | (2006.01) |
| ***B65H 75/42*** | (2006.01) |

(52) U.S. Cl.
CPC ..... *E04H 17/266* (2013.01); *B65H 49/20* (2013.01); *B65H 49/32* (2013.01); *B65H 59/04* (2013.01); *B65H 75/425* (2013.01)

(58) Field of Classification Search
CPC ..... B65H 49/20; B65H 75/42; B65H 75/425; E04H 17/26; E04H 17/261; E04H 17/266
USPC ..... 242/557
See application file for complete search history.

(56) References Cited

U.S. PATENT DOCUMENTS 3,107,878 A 10/1963 Wong
4,854,521 A * 8/1989 Farnsworth ..... A01K 3/00 242/419.9
5,042,737 A 8/1991 Sigle et al.
5,582,216 A * 12/1996 Smith ..... B21F 33/00 140/107
5,904,314 A 5/1999 Babcock, Jr.
7,195,193 B2 * 3/2007 Capps ..... E04H 17/266 242/396.5
7,699,259 B2 * 4/2010 Rawcliffe ..... E04H 17/266 242/403
2004/0065767 A1 4/2004 Parker
2004/0065768 A1 4/2004 Parker
2012/0048988 A1 3/2012 Pulver et al.

FOREIGN PATENT DOCUMENTS

GB 2516471 A * 1/2015 ..... E04H 17/266

* cited by examiner

*Primary Examiner* — William E Dondero
(74) *Attorney, Agent, or Firm* — George L Williamson

(57) ABSTRACT

Method and apparatus for an assembly which is attachable to a skid-steer or similar front end loader or tractor which is used to install fence wire. The assembly contains a plurality of spindles upon which rolls of wire can be placed, which wire passes through a threader which organizes and separates the wire, then through a clamping device operated hydraulically using electric and hydraulic controllers, then over a roller and around an upright wire guide whereupon the wire is attached to a fence post in a conventional manner. The wire is clamped using a clamping member operated by a hydraulic cylinder to clamp and lock the wire so that the wire can be stretched by the engine powered skid-steer, front end loader or the like so that the wire can be tightly attached to each fence post in a series operation. The plurality of spindles is disposed on an upright central stanchion attached to a platform so that the wire can be easily placed on and removed from the spindle.

16 Claims, 5 Drawing Sheets

FIG. 6
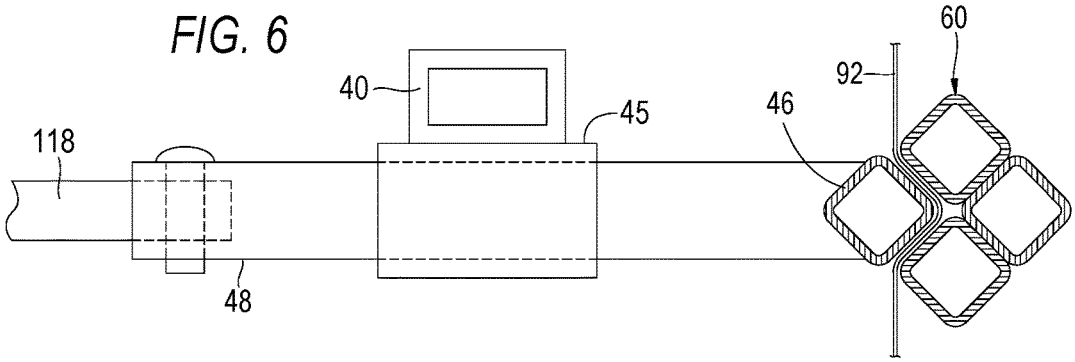
FIG. 7
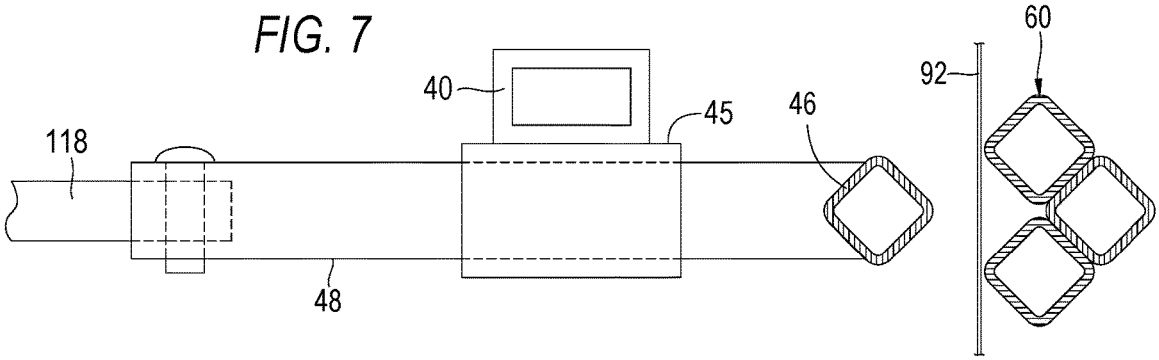
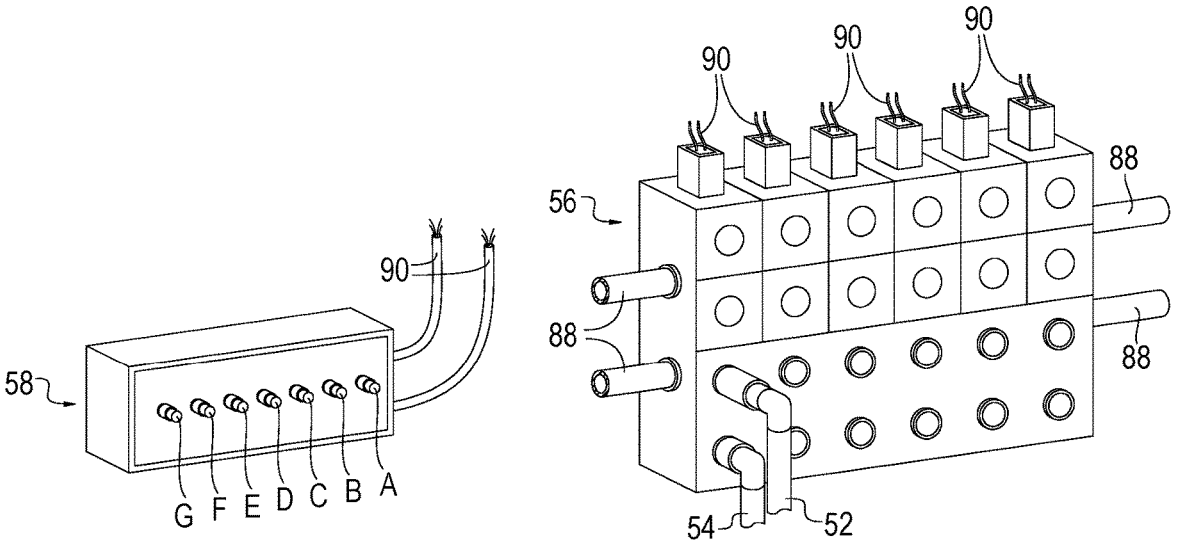
FIG. 8

METHOD AND APPARATUS FOR DISPENSING FENCE WIRE

BACKGROUND OF THE INVENTION

Field of the Invention

The present invention relates generally to farm implements, and, more particularly, is concerned with a method and apparatus for dispensing and installing fence wire.

Description of the Related Art

Devices relevant to the present invention have been described in the related art, however, none of the related art devices disclose the unique features of the present invention.

In U.S. Pat. No. 5,042,737 dated Aug. 27, 1991, Sigle, et al., disclosed a multiple wire dispensing assembly. In U.S. Patent Application Publication No. 2004/0065767 dated Apr. 8, 2004, Parker disclosed a vehicle attachable apparatus dispensing net wire/barbed wire. In U.S. Patent Application Publication No. 2012/0048988 dated Mar. 1, 2012, Pulver, et al., disclosed a barbed wire dispensing apparatus. In U.S. Pat. No. 5,904,314 dated May 18, 1999, Babcock, Jr. disclosed a fence wire dispensing apparatus. In U.S. Patent Application Publication No. 2004/0065768 dated Apr. 8, 2004, Parker disclosed a vehicle attachable apparatus dispensing net wire/barbed wire. In U.S. Pat. No. 3,107,878 dated Oct. 22, 1963, Wong disclosed a multiple reel carrier.

While these devices may be suitable for the purposes for which they were designed, they would not be as suitable for the purposes of the present invention as hereinafter described. As will be shown by way of explanation and drawings, the present invention works in a novel manner and differently from the related art.

SUMMARY OF THE PRESENT INVENTION

The present invention discloses an assembly which is attachable to a skid-steer or similar front end loader or tractor which is used to dispense and install fence wire being either barbed wire or other wire. The assembly contains a plurality of spindles upon which rolls of wire can be placed, which wire passes through a threader which organizes and separates the wire, then through a clamping device operated hydraulically using electric and hydraulic controllers, then over a roller and around an upright wire guide whereupon the wire is attached to a fence post in a conventional manner. The wire can be clamped using a clamp member operated by a hydraulic cylinder to lock the wire so that the wire can be stretched by the engine powered skid-steer, front end loader or the like so that the wire can be tightly attached to each fence post in a series operation. The plurality of spindles, which can be one to six, is disposed on an upright central stanchion attached to a platform so that the wire can be easily disposed on the spindle.

An object of the present invention is to provide an apparatus for automating the installation of fence wire. A further object of the present invention is to provide an apparatus which can be mounted onto a skid-steer or like tractor. A further object of the present invention is to provide an apparatus which can be electrically and hydraulically operated so as to ease the installation of the fence wire. A further object of the present invention is to provide an apparatus which can install a number of strands of wire being from one to six strands of wire. A further object of the present invention is to provide an apparatus which can be relatively easily operated by a user. A further object of the present invention is to provide an apparatus which can be relatively inexpensively manufactured.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 6 is a top view of portions of the present invention showing the clamp member closed.

FIG. 7 is a top view of portions of the present invention showing the clamp member open.

FIG. 8 is a perspective view of portions of the present invention.

LIST OF REFERENCE NUMERALS

Figure 1:
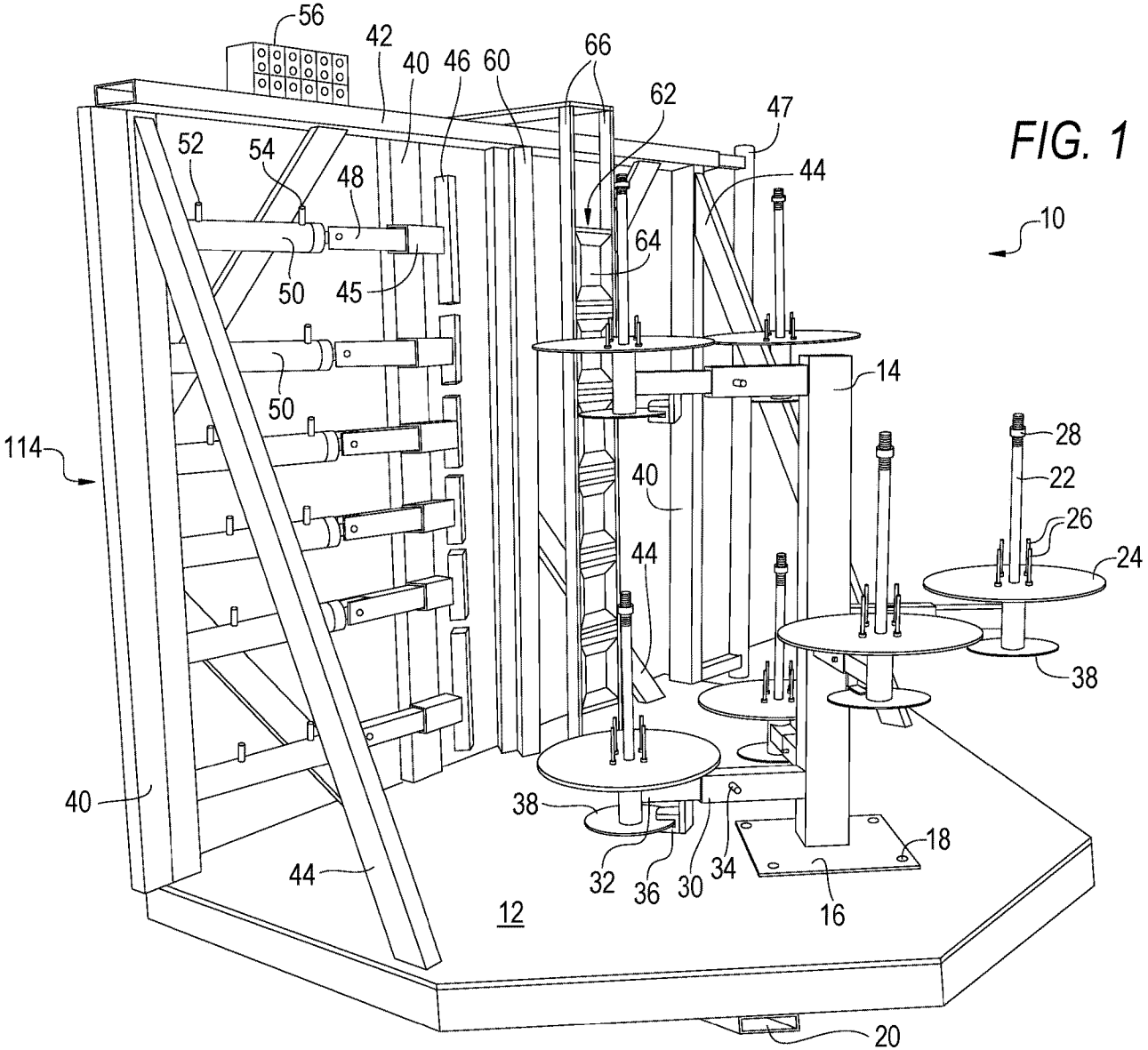
FIG. 1 is a perspective view of the present invention.

With regard to reference numerals used, the following numbering is used throughout the drawings.

10 present invention
12 platform
14 central stanchion/post
16 base
18 fastener
20 receptacle
22 vertical spindle
24 bottom disk
25 upper disk
26 finger
28 fastener
30 horizontal arm
32 telescoping arm
34 pin member
36 brake/tensioner caliper
37 mount for tensioner caliper
38 tensioner rotor
40 upright frame member
42 top plate frame member
44 angular support frame
45 collar
46 clamping member/arm

47 wire guide
48 hydraulic arm
50 hydraulic cylinder
52 hydraulic line
54 hydraulic line
56 hydraulic manifold
58 electric controller
60 wire clamp back stop
62 threader assembly
64 aperture of threader
66 vertical upright support frame for threader
68 forklift arms
70 vehicle/skid-steer
72 drive tracks
74 engine compartment
76 lift arms
78 operator area
80 operator
82 seat
86 hydraulic control
88 hydraulic lines
90 electrical lines
91 wire spool
92 wire
94 roller
95 connecting bearing block assembly
96 fence post
98 boom assembly
100 attachment member
102 hub
104 brake pad
106 handle
108 spring
110 lever
112 horizontal cross frame member
114 upright main frame assembly
116 telescoping member
118 hydraulic cylinder piston arm

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS. 1 through 8 illustrate the present invention wherein a method and apparatus for dispensing and installing fence wire is disclosed and which is generally indicated by reference number 10.

Turning to FIG. 1, therein is shown the present invention 10 including a lower base or platform 12 upon which some of the components of the apparatus are mounted which include a central stanchion or post 14 having a base 16 mounted to the upper surface of the platform using a plurality of fasteners 18 and having receptacles 20 underneath the platform 12 within which the forklift arms of the skid-steer (not shown, see FIG. 2) can be inserted so that the platform can be lifted and moved by the skid-steer in the conventional manner which will be hereinafter explained. A plurality of vertical spindles 22, being up to six in number, are shown mounted to the central post 14 wherein each spindle has a bottom disk 24 and a plurality of fingers 26 disposed on the bottom disk for securing a spool of wire to the spindle and having fasteners 28 on an upper end of each spindle 22 for securing an upper disk (not shown, see FIG. 3) thereto so that a roll of wire is secured to the spindle 22 between the upper and bottom disks. Each of the spindles 22 attaches to the central stanchion 14 using horizontal arms 30 having a telescoping arm portion 32 being laterally adjustable using pin 34 in a conventional manner and having attached thereto a brake or tensioner caliper 36 which cooperates with by clamping a tensioner rotor 38 disposed on a lower end portion of spindle 22 in order to tension the wire as it is unwound from the rolls of wire (not shown, see FIG. 3). Also shown mounted on platform 12 are a plurality of vertical or upright support members 40 forming vertical parts of the frame having left and right end members being joined together using a top plate-like frame member 42 all together forming an upright main frame assembly generally indicated by reference numeral 114 and being supported or braced by additional angular brace members 44 which can be done in numerous ways as would be done in the standard manner by one skilled in the art.

Shown attached to one of the upright frame members 40 are a plurality of wire clamping members/arms 46 which are associated with and provided for each spool of wire which is to be unwound wherein the clamping members are disposed on an end of a hydraulic arm 48 operated by a hydraulic cylinder 50 using hydraulic lines 52, 54 which are connected to a hydraulic manifold assembly 56 and which are operated by an electrical controller system 58 which provides a user interface for use by an operator. Each clamp member/arm 46 passes through a collar 45 attached to an upright frame member 40 and cooperates with a clamp back stop 60 so that wire passing thereinbetween can be clamped between the clamp member/arm 46 and the clamp backstop 60 when the hydraulic cylinder and arm and clamp member/arm are in a clamped position. FIG. 1 shows the clamp member/arm 46 in an unclamped position being spaced away from the back stop 60 wherein the wire is unclamped and will roll off the spool unimpeded. Also shown is a threader assembly 62 having apertures 64 so that one aperture 64 of the threader assembly 62 corresponds to each spool of wire for organizing and separating the wire as it is unrolled form the spools of wire so as to prevent wire tangled. The threader assembly 62 is mounted onto an upright support frame 66 as would be done in the standard manner by one skilled in the art wherein a lower end of the upright support frame 66 is mounted on platform 12 and an upper end is braced to the top plate frame member 42. Also shown is a wire guide member 47 which telescopes laterally from an upper and lower end of the upright main frame assembly 114.

Figure 2:
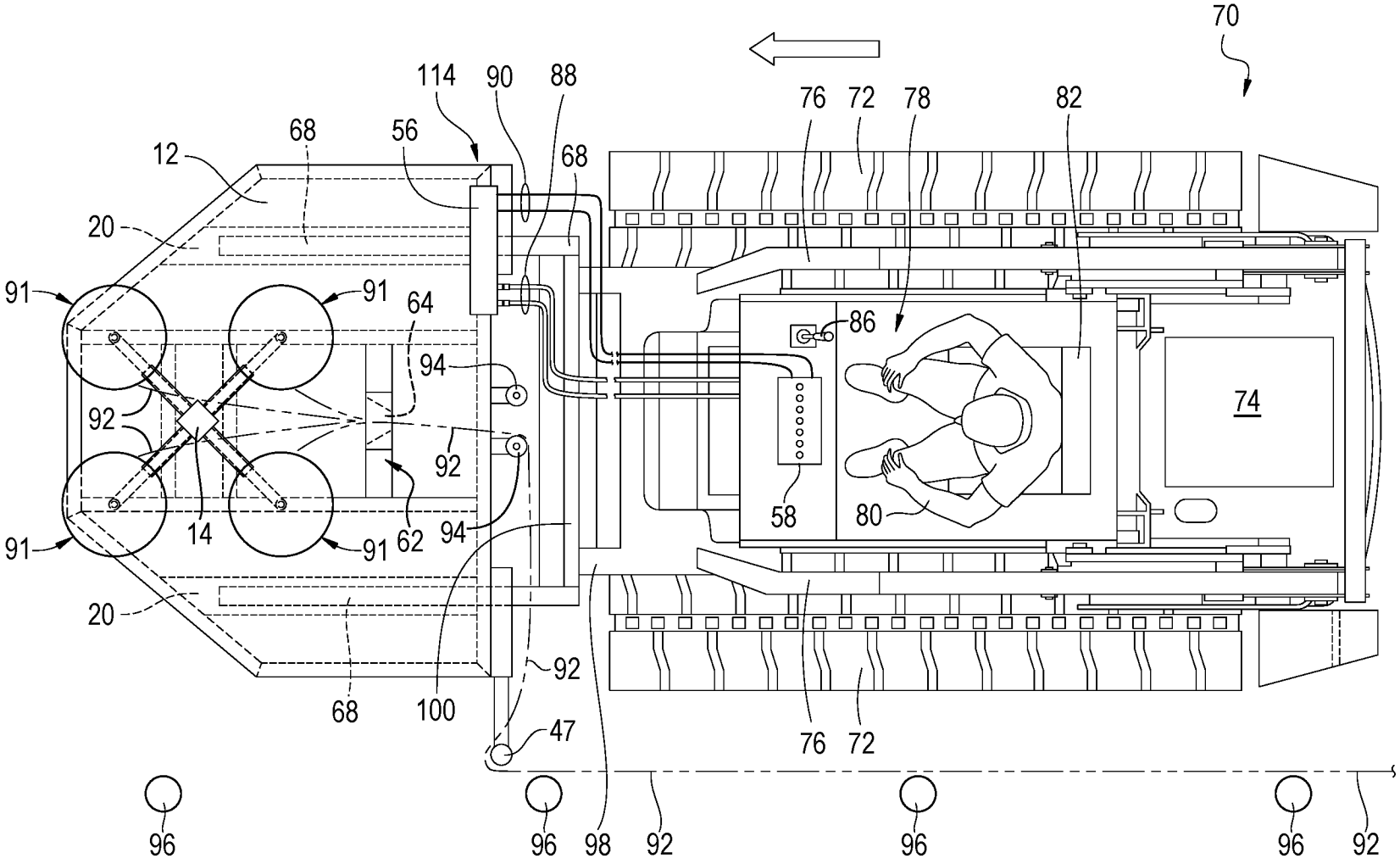
FIG. 2 is a plan view of the present invention shown in operative connection to a skid-steer.

Turning to FIG. 2, therein is shown the present invention 10 including a platform 12 having receptacles 20 underneath for receiving the forklift arms 68 of the vehicle or skid-steer 70 in the conventional manner. A conventional vehicle/skid-steer includes drive tracks 72 along with a rear engine compartment 74 including lift arms 76 which are all elements of a conventional skid-steer 70. Also note that the vehicle/skid-steer 70 has a boom assembly 98 upon which is mounted an attachment member 100 upon which the left and right front forklift arms 68 are attached to the skid-steer 70. Also shown is the operator's area 78 along with an operator 80 seated on the seat 82 so that a hand of the operator can manipulate the electrical controller 58 which is basically the only control in the skid-steer 70 which are required by and is unique to the present invention 10. The operator 80 would also be able to operate the hydraulic system of the skid-steer 70 so as to partially control the hydraulic manifold 56 of the present invention 10 by using the skid-steer's hydraulic control 86 which is a handle or like interface which is a standard controller found on a skid-steer, however, the main controller of the hydraulic manifold 56 and hydraulic cylinders 50 is the electrical controller 58.

Also shown are the hydraulic lines 88 which extend between the hydraulic manifold 56 and the onboard hydraulic system of the vehicle 70 which would have a hydraulic control 86, e.g., being a handle/interface, along with the electric lines 90 which extend between the electric control box 58 and the hydraulic manifold 56 as would be done in the standard manner by one skilled in the art. The purpose of these connections is to allow for electric over hydraulic control of the present invention 10. One skilled in the art would understand that a conventional skid-steer 70 is equipped with its own onboard hydraulic system and electrical system having standard connectors for making hydraulic and electrical connections to any attachments mounted on the skid-steer. Also shown disposed on the main platform 12 of the present invention 10 is the previously disclosed central stanchion 14. Also shown is wire 92 extending from each spool of wire through the threader aperture 64 of the threader assembly 62 and passing through an opening in the upright main frame assembly 114 and around the roller 94 which is disposed on the rear side of the upright main frame assembly 114 wherein the wire then passes around the wire guide 47 where upon the wire can be attached to each individual fence post 96 in a series operation manner which will be further described hereinafter.

Figure 3:
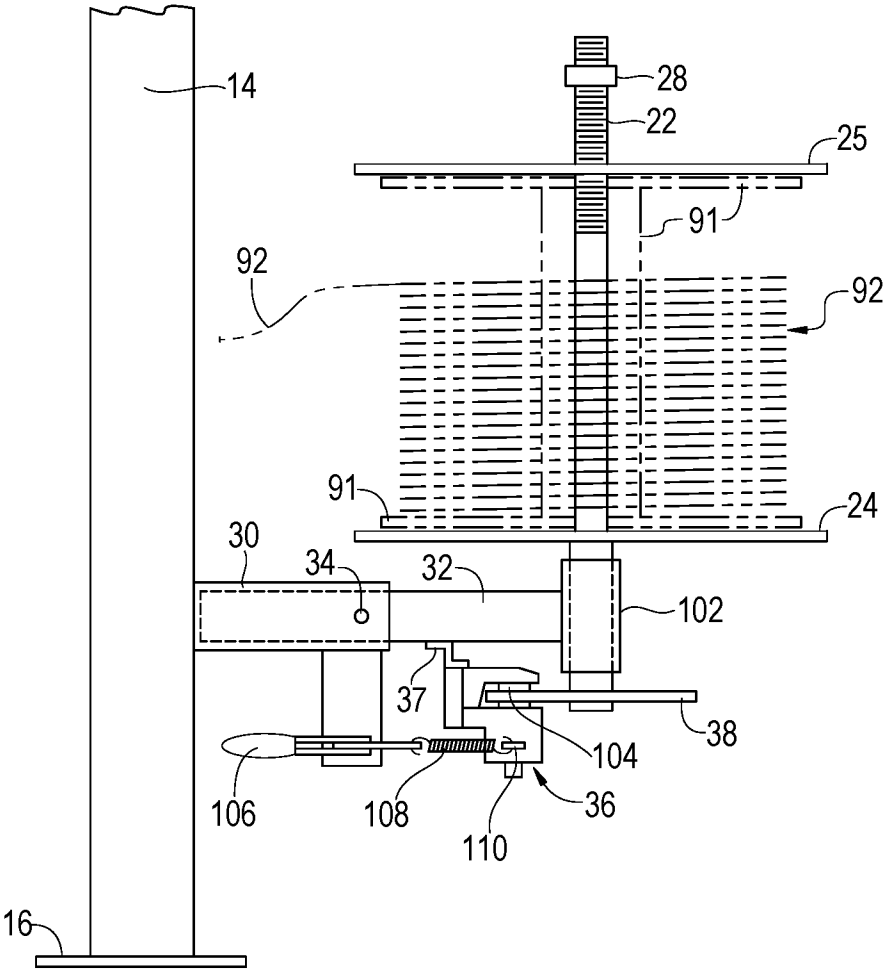
FIG. 3 is a side elevation view of portions of the present invention.

Turning to FIG. 3, therein is shown the central stanchion/post 14 mounted on a base plate 16 which would be mounted on platform 12 (not shown, see FIG. 1) having mounted on the central stanchion/post 14 a female horizontal arm 30 including the male telescoping extension arms 32 and the pin member 34 for adjusting the length of the telescopic extension arm and thereby the distance from arm 14 of spindle 22. Also shown is the vertical spindle member 22 having a bottom disk 24 along with an upper disk 25 with a wire spool 91 mounted in between the upper and lower disks 24, 25 which wire spool 91 would have wound upon it wire 92 which wire would be wound in the conventional manner around the spool 91. Also shown is a fastener 28 mounted on a threaded portion of the vertical spindle 22 used to secure wire spool 91 between disks 24, 25. The spindle 22 is mounted onto the telescopic extension arm 32 using a hub 102 which receives the spindle 22 therein.

Also shown is conventional tensioner or brake caliper 36 having a tensioner rotor 38 cooperating therewith and using a pair of brake pads 104 between which pads the tensioner rotor 38 is positioned. The tensioner calipers 36 are mounted to an underside of the telescoping extension arm 32 using a mount 37. The tensioner caliper 36 is manually actuated using a handle 106 which handle has first and second positions so that in the first position the rotors 38 would be clamped or tensioned between the brake pads 104 and in a second position the rotor 38 would be unclamped and free to rotate between the brake pads 104. Also shown is a spring 108 for connecting the handle 106 to a tensioner lever 110 on the side of the tensioner caliper 36 wherein lever 110 actuates brake pads 104. The tension on the tensioner rotor 38 is manually adjustable.

Figure 4:
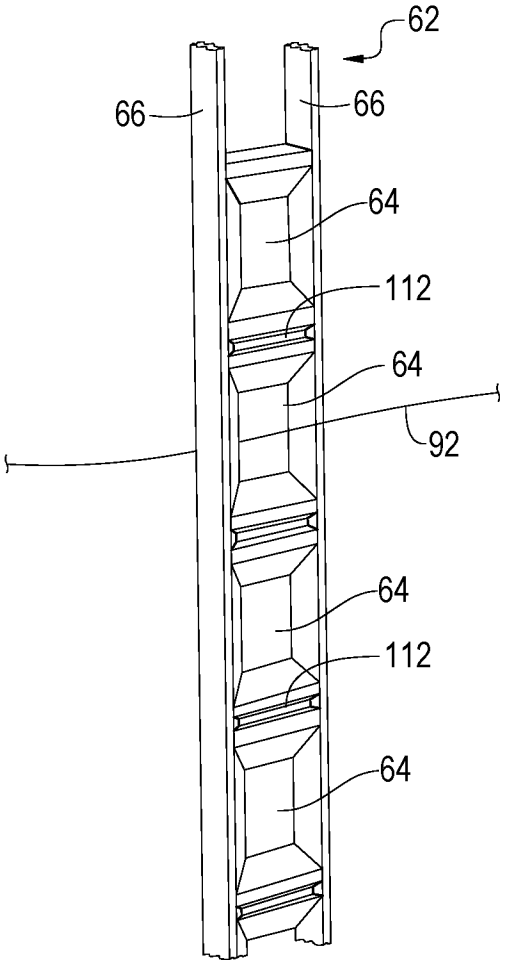
FIG. 4 is a perspective view of portions of the present invention.

Turning to FIG. 4, therein is shown the threader assembly 62 having left and right vertical threader support frame members 66 for supporting a plurality of apertures 64 through which wire 92 from the wire spools can pass so as to keep the wire strands separated from each other so as not to become tangled thereby causing a problem with the installation process. Also shown are a plurality of horizontal cross frame members 112 which pass between the left and right vertical support members 66. One exemplary strand of wire 92 is shown passing through one of the apertures 64.

Figure 5:
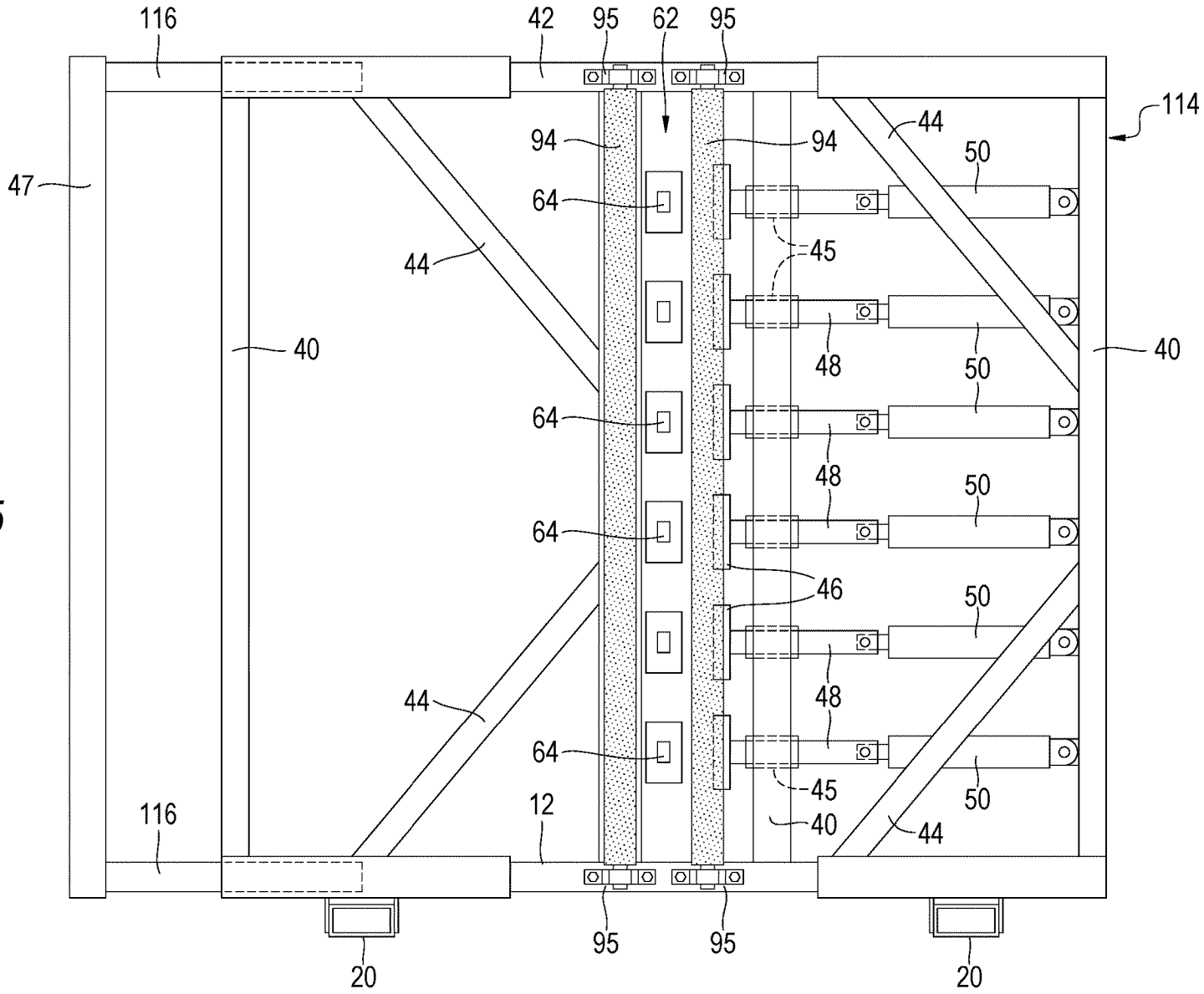
FIG. 5 is a rear view of the upright main frame assembly of the present invention.

Turning to FIG. 5, therein is shown the rear side of the upright main frame assembly 114 showing the left and right rollers 94 connected to the upright main frame assembly 114 by using upper and lower connecting bearing block assemblies 95. Also shown is wire guide member 47 which telescopes laterally from an upper and lower end of the upright main frame assembly 114 so as to be adjustable in length using upper and lower laterally telescoping members 116. Other previously disclosed elements are also shown.

Turning to FIGS. 6-7, therein is shown a clamp member/arms 46 which is disposed on an end of a hydraulic arm 48. Each clamp member/arm 46 passes through a collar 45 attached to an upright frame member 40 and cooperates with a clamp back stop 60 so that wire 92 passing thereinbetween can be clamped between the clamp member/arm 46 and the clamp backstop 60 when the hydraulic cylinder and arm and clamp member/arm are in a clamped/closed position as shown in FIG. 6. Also shown is the hydraulic cylinder piston arm 118. FIG. 7 shows the clamp member/arm 46 in a unclamped/open position so that wire 92 is free.

Turning to FIG. 8, therein are shown the hydraulic manifold 56 and the electric controller 58. The hydraulic manifold 56 shows the hydraulic lines 52, 54 which would connect to each individual hydraulic cylinder 50 so that the hydraulic cylinder would operate in the conventional open/closed position so as to open/close the clamp member/arm 46 (not shown, see FIG. 1). The hydraulic manifold 56 also shows hydraulic lines 88 which would extend to and connect to the hydraulic system of the skid-steer 70 (not shown, see FIG. 2) along with the electrical lines/connections 90 which would extend to and connect to the electric controller 58 as previously disclosed. Also shown is the electric controller 58 having seven switches A-G in total, wherein switches A-F operate the hydraulic cylinders 50 in and out individually, and, the seventh switch G to operate all six hydraulic cylinders in and out together; also shown are the electrical lines/connections 90 which would extend to and connect to the hydraulic manifold 56 as previously disclosed.

In operation, the present invention 10 is attached to a skid-steer or tractor 70 and it can receive from one to six strands of barbed or smooth wire 92 for fence stringing. With the present invention 10, one can control each strand or wire 92 individually with the electric 58 over hydraulics 56 system with the control box 58 from in the cab 78 of the tractor or skid-steer 70. The electrical control box 58 has seven switches A-G in total, wherein switches A-F operate the hydraulic cylinders in and out individually, and, the seventh switch G operates all six cylinders in and out together. Electrical connections 90 are also shown which allow the electrical control box 58 to be electrically connected to the hydraulic manifold 56.

Continuing with the explanation of the operation, a user 80 places the wire roll(s) or spools 91 onto the spindle 22 and unlocks the spool brake 36 and runs wire 92 through the threader 62 and then runs the wire through the hydraulic clamp 46 and over rollers 94 and pulls the wire out to wire guide 47 and attaches it to fence post 96 and sets the spool brake 36. The user 80 repeats these steps on each spool of wire he wishes to string. Then, the user moves the tractor 70 forward to the first fence post 96 you wish to attach your wire to and engage the seventh switch G to lock all hydraulic clamps. Then, the user moves the tractor 70 forward to apply tension on the wire strand(s) and attach them to the fence post 96 in the conventional manner. The wire strands 92 that are not tensioned tightly are left clamped 46 while the clamp is disengaged from the properly tensioned strands using the appropriate corresponding switches A-G and the tractor 70 is moved forward to tension the remaining strands and attach them to fence post 96. Then, disengage all clamps 46 and move tractor 70 forward to repeat operation at the next fence post 96 in a series type operation.

By way of general explanation of a skid-steer 70, a skid-steer is a relatively small rigidly constructed, engine-powered at 74 machine having lift arms 76 thereon which arms are used to attach a wide variety of construction-related attachments, e.g., a bucket or the present invention 10. Skid-steer loaders 70 are typically wheeled (or tracked at 72) vehicles with the wheels mechanically locked in synchronization on each side so that the left-side drive wheels can be driven independently of the right-side drive wheels. The wheels or tracks 72 typically have no separate steering mechanism and maintain a fixed straight alignment on the body of the machine. By operating the left and right wheel pairs at different speeds, the machine turns by skidding, or dragging its fixed-orientation wheels across the ground. The extremely rigidly constructed frame and strong wheel bearings prevent the torsional forces caused by this dragging motion from damaging the machine. Skid-steer loaders 70 are capable of essentially zero-radius turning, which makes them extremely maneuverable and useful for applications that require a compact, agile vehicle. Skid-steer loaders 70 may be equipped with tracks 72 in lieu of the wheels. Unlike in a conventional front loader, the lift arms 76 in skid-steer loaders 70 are alongside the driver 80 and the pivot points may be behind the driver's shoulders. Like other front loaders, it can push material from one location to another, carry material in its bucket, load material into a truck or trailer or operate the present invention 10.

By way of an additional summary and by making reference to FIGS. 1-8, the present invention 10 may be described as a method for dispensing wire, including a) providing a platform 12 having an upper surface thereon; b) placing a spindle 22 on the platform, the spindle configured to receive a spool 91 for carrying wire 92 thereon so that the wire can be dispensed from the spool; c) providing an upright main frame assembly 114 on the platform; d) providing a wire clamping member 46 on the upright main frame assembly to permit the wire to be releasably clamped, the wire clamping member having a first position wherein the wire is free to be dispensed from the spool and a second position wherein the wire is clamped in place; e) providing a threader assembly 62 configured to prevent the wire from becoming tangled as the wire is dispensed from the spool, the threader assembly having an aperture 64 thereon, wherein the aperture is positioned to cooperate with the spool so that the wire is aligned with the wire clamping member; f) providing a wire roller 94 on the upright main frame assembly to assist with dispensing the wire from the spool; and, g) providing a wire guide 47 on a side of the upright main frame assembly so that the wire is guided away from the upright main frame assembly as the wire is dispensed from the spool. Furthermore, including an upright post 14 having a lower end disposed on the upper surface of the platform, wherein the spindle is disposed on the upright post, wherein there are up to six spindles, wire clamping members, and apertures disposed on the platform, wherein one wire clamping member and one aperture corresponds to each spindle, the step of tensioning at 38 the spindle for tensioning the wire as the wire is dispensed from the spool, wherein each spindle is configured so that a distance between the spindle and the upright post is adjustable at 30, 32, and providing a hydraulic cylinder 50 adapted for moving each wire clamping member between the first and second positions. Furthermore, wherein the hydraulic cylinder is controlled by a hydraulic controller 58 in the vehicle 70 so that the wire clamping member is controlled by an operator 80 in the vehicle, wherein the wire guide is laterally adjustable at 116 so that the path of the wire dispensed from the spool is adjustable, and providing a receptacle 20 on the platform for receiving therein a forklift arm 68 of a vehicle.

I claim:

1. An apparatus for dispensing wire, the apparatus for attachment to a vehicle, comprising:

a) a platform having an upper surface thereon;

b) a spindle being disposed on said platform, said spindle configured to receive a spool for carrying wire thereon so that said wire can be dispensed from said spool;

c) an upright main frame assembly disposed on said platform;

d) a wire clamping member being disposed on said upright main frame assembly to permit said wire to be releasably clamped, said wire clamping member having a first position wherein said wire is free to be dispensed from said spool and a second position wherein said wire is clamped in place;

e) a threader assembly configured to prevent said wire from becoming tangled as said wire is dispensed from said spool, said threader assembly having an aperture thereon, wherein said aperture is positioned to cooperate with said spool so that said wire is aligned with said wire clamping member;

f) a wire roller disposed on said upright main frame assembly to assist with dispensing said wire from said spool;

g) a wire guide disposed on a side of said upright main frame assembly so that said wire is guided away from said upright main frame assembly as said wire is dispensed from said spool; and h) an upright post having a lower end disposed on said upper surface of said platform, wherein said spindle is disposed on said upright post, wherein each said spindle is configured so that a distance between said spindle and said post is adjustable.

2. The apparatus of claim 1, wherein there are up to six said spindles, said wire clamping members, and said apertures disposed on said platform.

3. The apparatus of claim 2, wherein one said wire clamping member and one said aperture corresponds to each said spindle.

4. The apparatus of claim 1, further comprising a tensioner being disposed on each said spindle for tensioning said wire as said wire is dispensed from said spool.

5. The apparatus of claim 1, further comprising a hydraulic cylinder adapted for moving each said wire clamping member between said first and second positions.

6. The apparatus of claim 5, wherein said hydraulic cylinder is controlled by a controller in the vehicle so that said wire clamping member is controlled by an operator in the vehicle.

7. The apparatus of claim 1, wherein said wire guide is laterally adjustable so that a path of said wire dispersed from said spool is adjustable.

8. The apparatus of claim 1, further comprising a receptacle disposed on said platform for receiving therein a forklift arm of the vehicle for attaching the apparatus to the vehicle.

9. A method for dispensing wire, comprising the steps of:

a) providing a platform having an upper surface thereon;

b) placing a spindle on the platform, the spindle configured to receive a spool for carrying wire thereon so that the wire can be dispensed from the spool;

c) providing an upright main frame assembly on the platform;

d) providing a wire clamping member on the upright main frame assembly to permit the wire to be releasably clamped, the wire clamping member having a first position wherein the wire is free to be dispensed from the spool and a second position wherein the wire is clamped in place;

e) providing a threader assembly configured to prevent the wire from becoming tangled as the wire is dispensed from the spool, the threader assembly having an aperture thereon, wherein the aperture is positioned to cooperate with the spool so that the wire is aligned with the wire clamping member;

f) providing a wire roller on the upright main frame assembly to assist with dispensing the wire from the spool;

g) providing a wire guide on a side of the upright main frame assembly so that the wire is guided away from the upright main frame assembly as the wire is dispensed from the spool; and h) providing an upright post having a lower end disposed on the upper surface of the platform, wherein the spindle is disposed on the upright post, wherein each spindle is configured so that a distance between the spindle and the upright post is adjustable.

10. The method of claim 9, wherein there are up to six spindles, wire clamping members, and apertures disposed on the platform.

11. The method of claim 10, wherein one wire clamping member and one aperture corresponds to each spindle.

12. The method of claim 9, further comprising the step of tensioning the spindle for tensioning the wire as the wire is dispensed from the spool.

13. The method of claim 9, further comprising the step of providing a hydraulic cylinder adapted for moving each wire clamping member between the first and second positions.

14. The method of claim 13, wherein the hydraulic cylinder is controlled by a controller in the vehicle so that the wire clamping member is controlled by an operator in the vehicle.

15. The method of claim 9, wherein the wire guide is laterally adjustable so that the path of the wire dispensed from the spool is adjustable.

16. The method of claim 9, further comprising the step of providing a receptacle on the platform for receiving therein a forklift arm of a vehicle.

* * * * *